US005271450A

United States Patent [19]

Bailey

[11] Patent Number: 5,271,450

[45] Date of Patent: Dec. 21, 1993

[54] THERMAL RECLAMATION METHOD

[75] Inventor: Ian A. Bailey, Huncote, England

[73] Assignee: Richards Engineering Limited, Leicester, United Kingdom

[21] Appl. No.: 838,740

[22] PCT Filed: Mar. 3, 1991

[86] PCT No.: PCT/GB91/00714

§ 371 Date: Mar. 10, 1992

§ 102(e) Date: May 10, 1992

[87] PCT Pub. No.: WO91/17848

PCT Pub. Date: Nov. 28, 1991

[30] Foreign Application Priority Data

May 11, 1990 [GB] United Kingdom ..... 9010611

[51] Int. Cl.[5] ..... B22D 29/00

[52] U.S. Cl. ..... 164/5; 110/236; 110/245; 241/DIG. 10

[58] Field of Search ..... 164/5; 241/DIG. 10; 110/236, 245

[56] References Cited

U.S. PATENT DOCUMENTS

| | | | |
|---|---|---|---|
| 3,399,637 | 9/1968 | Hirschfield | 110/245 |
| 3,772,999 | 11/1973 | Miller, Jr. et al. | 110/245 |
| 3,907,674 | 9/1975 | Roberts et al. | 110/245 X |
| 4,427,375 | 1/1984 | Di Rosa | 110/245 X |
| 4,434,726 | 3/1984 | Jones | 110/245 X |

FOREIGN PATENT DOCUMENTS

| | | |
|---|---|---|
| 0050526 | 4/1982 | European Pat. Off. . |
| 2814239 | 10/1979 | Fed. Rep. of Germany . |
| 3903604 | 3/1990 | Fed. Rep. of Germany . |
| 731923 | 6/1955 | United Kingdom . |
| 1384010 | 2/1975 | United Kingdom . |
| 1562035 | 3/1980 | United Kingdom . |
| 2056048A | 3/1981 | United Kingdom . |
| 2077614 | 12/1981 | United Kingdom . |

OTHER PUBLICATIONS

Modern Casting vol. 70, No. 9, Sep. 1980, Des Plaines, Ill. pp. 40–43; Tony Suschil: "Modernizing Sand Handling", see table, p. 42.

*Primary Examiner*—J. Reed Batten, Jr.
*Attorney, Agent, or Firm*—Basile and Hanlon

[57] ABSTRACT

A base material is thermally reclaimed from a mixture of the base material and a combustible substance, wherein the substance is incinerated in a fluidized bed, comprises the step of feeding the mixture after comminuting and dust from comminuting step directly into a lower part of the fluidized bed. The method is particularly suitable for the thermal reclamation of foundry sand or other base materials used in foundry processes.

8 Claims, 2 Drawing Sheets

THERMAL RECLAMATION METHOD

BACKGROUND OF THE INVENTION

1. Field of the Invention

This invention relates to a method of and apparatus for thermally reclaiming a material, such as foundry sand.

2. Background Description

Used foundry sand is normally subjected to reclamation so that it can be re-used in foundry processes. Such reclamation can take the form of mechanical attrition, whereby the sand is broken down into grain-size particles. However, used foundry sand contains a high proportion of chemical bonding agents, notably phenolic resins, and after a while these agents reach such a level that the sand becomes unusable, even with mechanical reclamation. Consequently, there is a need for a thermal reclamation technique whereby the chemical agents are incinerated, leaving relatively clean sand ready for re-use. Such reclamation is typically conducted in a furnace having a fluidized bed.

Because the chemical agents are very volatile, in principle, the reaction in the fluidized bed is substantially self-sustaining. That is to say, in theory at least, once the combustion process has reached a steady state from start-up (typically at around 800° C.), there is no need to supply significant amounts of fuel gas since the combustion is supported instead by burning of the chemical agents. In practice, however, this does not happen for the following reasons.

According to conventional practices, the sand/bonding agent mixture is fed into the fluidized bed from above and will comprise a mixture of relatively light particles (i.e., dust) and relatively heavy particles. The velocity of the air passing through the fluidized bed (which must be above the minimum required to maintain fluidity) is such that it exceeds the settlement rate of the relatively light particles and carries these light particles upwardly into the hood and stack of the furnace. This effect is compounded by expansion of the air as it is heated by the bed. Because the relatively light particles tend to comprise a high proportion of the bonding agent (up to 50% in some cases), they have a high calorific value and will burn in the hood or stack, subject to there being sufficient oxygen available. This causes excessive heat generation in the upper parts of the furnace.

The relatively heavy particles are also highly volatile, with the result that ignition tends to occur spontaneously as the particles impinge upon the top of the fluidized bed, so that bulk of the combustion takes place in the top region of the bed. This not only acts against the supposed self-sustaining reaction of the combustion, but also adds to the heating effect on the hood and stack. These combined effects give rise to excessive heat in the flue gases and, indeed, it is sometimes the case that the flue gases end up hotter than the fluidized bed itself.

In order to deal with this problem, attempts have been made to recover some of the heat from the flue gases by using a heat exchanger. The recovered heat is then used either to pre-heat the incoming sand/bonding agent mixture or to pre-heat the air supplied to the fluidized bed. However, this gives rise to further problems. For example, pre-heating of the sand/bonding agent mixture can make the sand sticky and unmanageable and can also give rise to the emission of noxious vapors. Also, the amount of heat recoverable from the hot flue gases far exceeds that needed for pre-heating the air for the fluidized bed. Furthermore, heat exchangers are high maintenance items and the dust entrained in the flue gases tends to adhere to the heat-exchange surfaces, causing a build-up which must be cleared periodically.

Another problem arises due to the fact that, when feeding from above, it is very difficult to do anything other than put the sand/bonding agent mixture into a very localized region of the fluidized bed. This creates a cold spot at the point of entry of the mixture into the bed. Indeed, it is often the case that this spot cools to such an extent that the bonding agent ceases to be incinerated satisfactorily, so that noxious vapors containing a high proportion of unburnt hydrocarbons are given off. For this reason, it is often necessary to use an afterburner.

Furthermore, because the sand/bonding agent mixture is fed into the bed from above, the silos or hoppers containing the mixture must be provided at an elevated location for gravity feed of the material into the bed. This in itself gives rise to a degree of inconvenience.

SUMMARY OF THE INVENTION

It is an object of the present invention to obviate or mitigate these problems and disadvantages.

According to one aspect of the present invention, there is provided a method of thermally reclaiming a base material (such as foundry sand) from a mixture of the base material and a combustible substance, wherein the substance is incinerated in a fluidized bed, the method comprising the step of feeding the mixture directly into a lower part of the fluidized bed.

Preferably, the mixture is fed into the fluidized bed from beneath the fluidized bed.

Conveniently, the mixture is fed (preferably continuously) to a confined space beneath the fluidized bed by means of a mechanical conveyor.

Alternatively, the mixture can be fed to the fluidized bed by a pneumatic conveyor, and is preferably injected into the bed at substantially the same level as the fluidizing air/gas mixture.

In cases where the mixture is fed to the fluidized bed in batches, a plurality of feeds are preferably provided which operate in sequence. For example, where two such feeds are provided, these feeds can operate alternately.

Advantageously, the mixture is mechanically comminuted and dust from the comminution process is mixed with the mixture for feeding to the fluidized bed.

According to a second aspect of the present invention, there is provided a thermal reclamation apparatus for thermally reclaiming a base material from a mixture of the base material and a combustible substance, the apparatus comprising a fluidized bed, and means for feeding the mixture directly into a lower part of the fluidized bed.

Preferably, the feeding means includes a mechanical conveyor which feeds the mixture into a confined space beneath the fluidized bed.

Alternatively, the feeding apparatus can include a pneumatic conveyor having feed pipes which preferably terminate at substantially the same level in the fluidized bed as nozzles which feed the air/gas mixture into the bed.

Advantageously, the feeding means includes a plurality of pneumatic conveyors each of which feeds the mixture to the fluidized bed in batches, and means to operate the pneumatic conveyors in sequence.

BRIEF DESCRIPTION OF THE DRAWING

The invention will now be further described, by way of example only, with reference to the accompanying drawings, in which.

DESCRIPTION OF THE PREFERRED EMBODIMENTS

Figure 1:
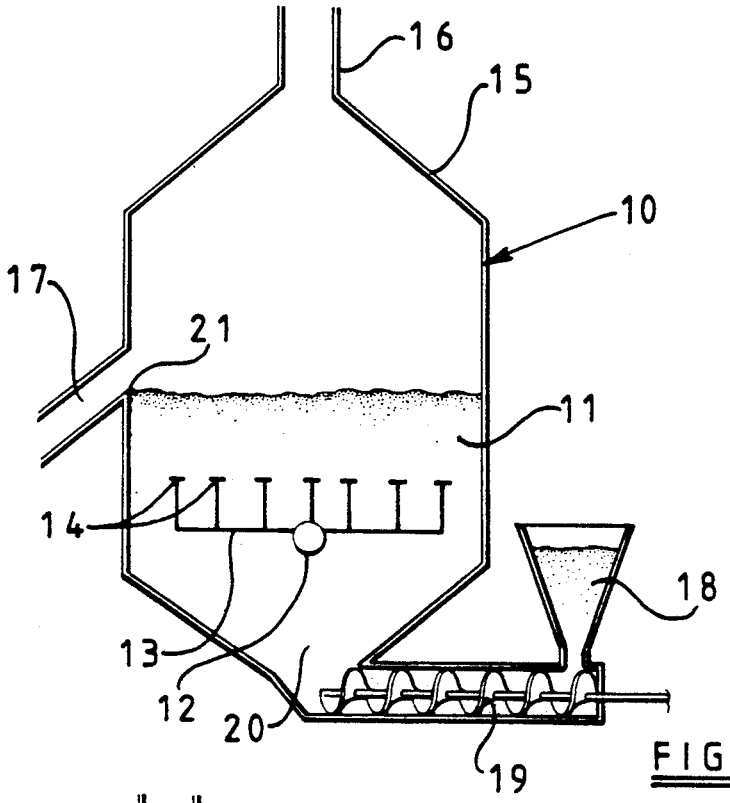
FIG. 1 is a schematic view of one embodiment of a thermal reclamation apparatus according to the present invention.

Referring first to FIG. 1, a first embodiment of apparatus according to the present invention comprises a furnace 10 containing a fluidized bed 11 to which an air/fuel gas mixture is supplied by way of a manifold 12, pipes 13 and nozzles or bubble caps 14. Above the fluidized bed 11 the furnace 10 has a hood 15 and a stack 16 through which flue gas can pass, while to one side of the bed 11 there is an exit chute 17 through which material can be drawn off from the top of the bed 11.

In use, material to be reclaimed (such as a comminuted mixture of foundry sand and phenolic resin bonding agent) is fed from a silo or hopper 18 by a mechanical conveyor 19 (such as a screw conveyor) to a confined space 20 beneath the fluidized bed 11. The continuous feed of this material causes the mixture to rise progressively through the space 20 and to enter the fluidized bed 11 from below through the interstices between the bubble caps 14. This ensures that all of the material, i.e., both relatively light and relatively heavy particles, is passed through the full body of the fluidized bed 11 and that therefore the resin bonding agent is properly incinerated with the bed 11 itself. In this way, the fluidized bed 11 can be arranged to achieve the theoretical self-supporting combustion reaction, so that the quantity of fuel gas used can be drastically reduced once the bed 11 has reached its steady state from start-up. Moreover, because there is no combustion in the space above the bed 11, the flue gases can be kept at a much lower temperature than has previously been the case. Furthermore, because the material is fed into the bed 11 substantially uniformly across its area, no localized cold spots are created.

Figure 2:
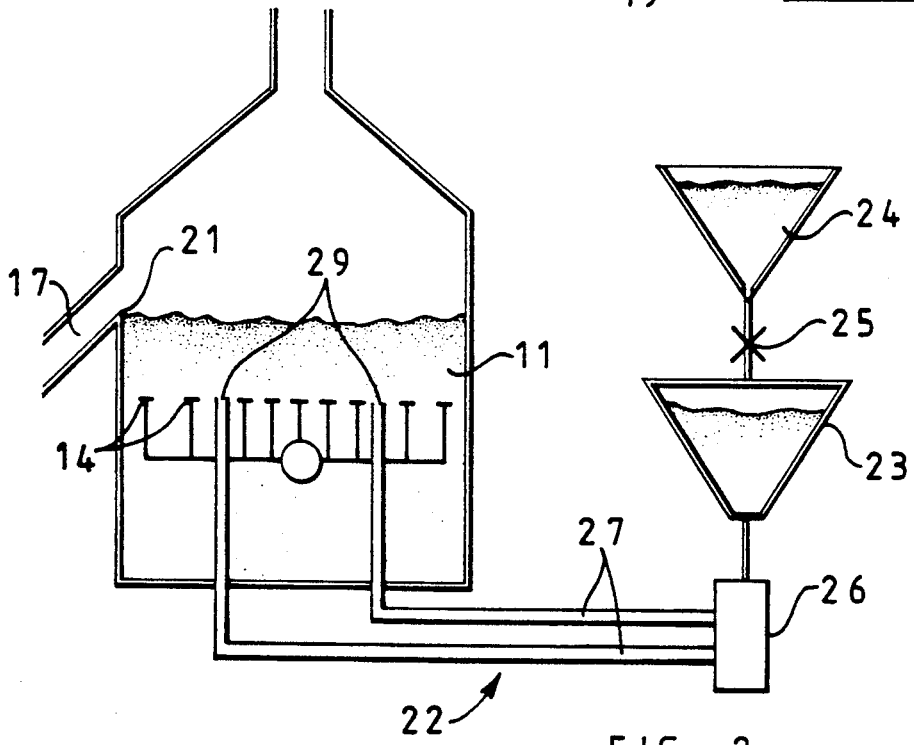
FIG. 2 is a schematic view of a second embodiment of a thermal reclamation apparatus according to the present invention.

FIG. 2 shows a second embodiment of the apparatus wherein the sand/bonding agent mixture is fed to the fluidized bed 11 by means of a pneumatic conveyor 22. More particularly, a pressure vessel 23 is periodically charged with the mixture from a silo/hopper 24 via a valve 25. The pressure vessel 23 communicates with a manifold 26, which in turn communicates with pneumatic conveyor lines 27 by way of respective valves, now shown. The conveyor lines 27 terminate at respective injection nozzles 29 disposed at approximately the same level as the bubble caps 14.

Once the vessel 23 has been charged with a sufficient volume of the mixture, the valve 25 is closed and the vessel 23 is pressurized so that the mixture is conveyed pneumatically to the bed 11 through the conveyor lines 27 and the nozzles 29. As with the previous embodiment, the sand/bonding agent mixture is fed directly into the lower part of the fluidized bed 11 and passes upwardly therethrough as it is processed. Consequently, the bonding agent is properly incinerated in the bed 11 itself, and there is no combustion in the space above the bed. This embodiment also has the added advantage that oxygen is fed into the bed 11 not only in the normal manner with the fuel gas through the bubble caps 14, but also in the air employed in the pneumatic conveyor 22. Injection of the material into the bed 11 can be made as uniform as possible (to avoid the creation of any cold spots) by providing as many injection nozzles 29 as is practical across the whole area of the fluidized bed 11.

In both of the above-described embodiments, processed material (i.e., clean sand) is continuously drawn off through an exit chute 17 as the level of the top of the fluidized bed 11 rises above a weir 21, while material for reclamation is continuously fed into the bed 11 from below.

Before processing in the fluidized bed 11, the material is subjected to mechanical attrition to break it down into grain-sized particles. This process does, however, create a great deal of dust which tends to contain a high proportion of the bonding agent. Such dust is also created in other processing operations carried out on the material. Care has to be taken in incinerating this dust, since noxious vapors can be given off if the incineration temperature is not high enough. If desired, the material fed into the apparatus can be mixed with such dust which will ensure that the dust is properly incinerated in the fluidized bed 11.

Figure 3:
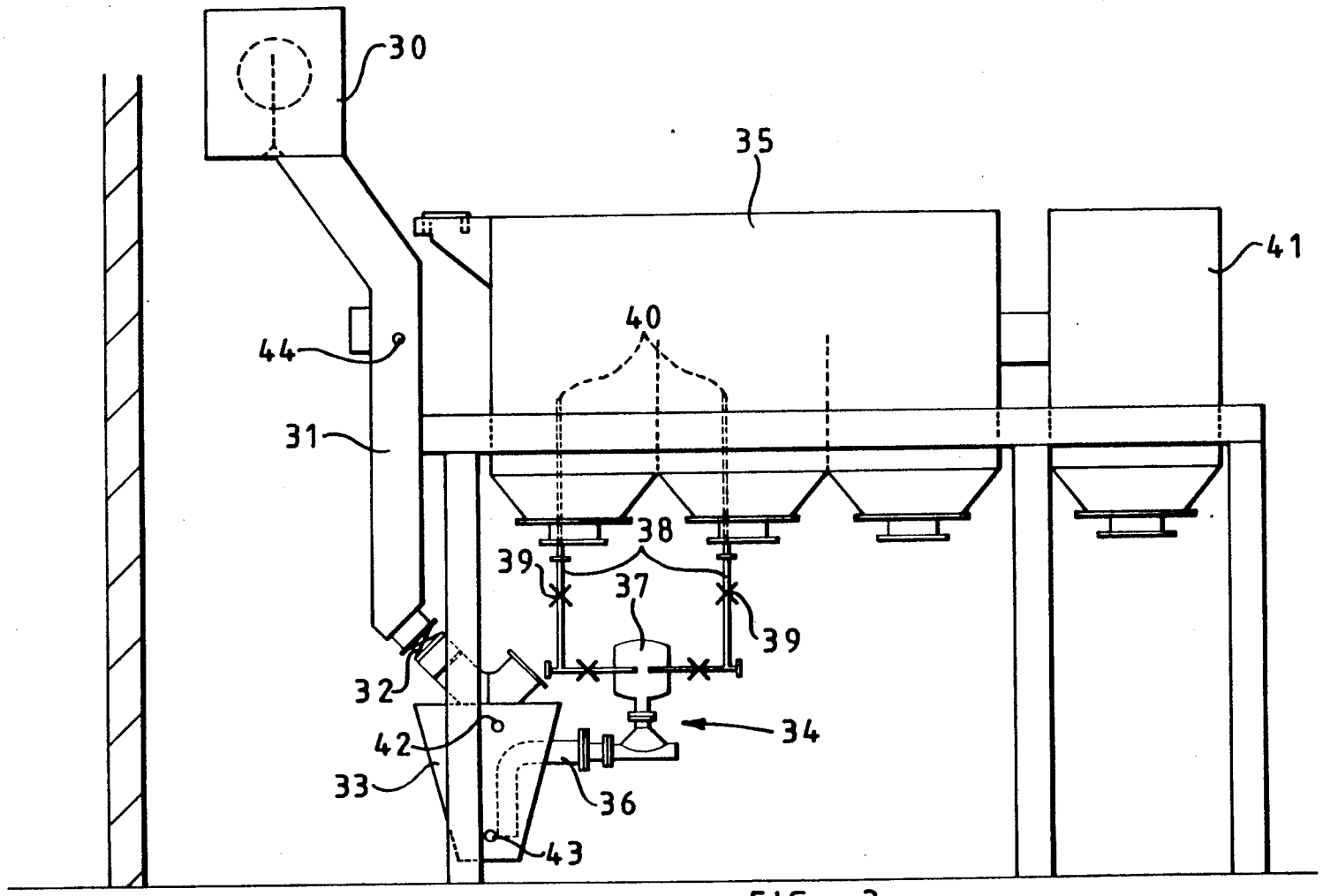
FIG. 3 shows a detailed illustration of the apparatus depicted in FIG. 2.

FIG. 3 shows a detailed version of the apparatus depicted schematically in FIG. 2. Used material from a casting process is fed through a hopper 30 containing a drum magnet for removing pieces of metal. From there, the material passes down a chute 31 and via a valve 32 to a pressure vessel 33. A pneumatic conveyor 34 extends from the pressure vessel 33 to a fluidized bed 35, and includes an inlet pipe 36, a manifold 37 and a plurality of pneumatic lines 38 extending from the manifold 37. Each line 38 is provided with a valve 39 for regulating the flow of material to the bed 35, and terminates at an injector 40 disposed at approximately the level of bubble caps (not shown) in the bed 35. To one side of the bed 35 there is provided a cooler/classifier 41 to which material flows from the bed 35 over a weir (not shown). If desired, an after-bed (not shown) can be interposed between the bed 35 and the cooler/classifier 41.

The pressure vessel 33 is provided with a high level probe 42 and a low level probe 43. When the level of material in the vessel 33 reaches the probe 42, the valve 32 is automatically shut off and the vessel is pressurized so that the material is then conveyed by the conveyor 34 into the lower part of the fluidized bed 35. When the level of material in the vessel 33 has fallen to the low level probe 43, the vessel 33 is depressurized and the valve 32 is opened once again. In this way, the material is fed in batches from the vessel 33 to the bed 35.

The provision of the low level probe 43 prevents the mixture from being completely exhausted from the pneumatic conveyor 34 after each batch feed operation, so that hot sand from the bed 35 is prevented from running through the system and into the vessel 33 under the action of gravity. The apparatus can also be provided with a charging or priming system which, as the bed 35 is about to be shut down, allows clean sand to be fed into the vessel 33 and into the conveyor 34. In this way, it is ensured that these parts do not contain any bonding agent during shut down which might otherwise cause rebonding of the sand and consequent clogging of the pneumatic conveyor 34.

As described above, foundry sand for reclamation is fed in batches to the fluidized bed 35. However, a substantially continuous feed can be provided by arranging a series of pressure vessels 33 and pneumatic conveyors 34 in parallel. Thus, where two such systems are provided, one pressure vessel 33 can be charged with material from the chute 31 at the same time as material from the other vessel 33 is conveyed to the bed 35.

Reference numeral 44 designates a detector provided in the chute 31 to regulate the flow of the material to the vessel 33. During pressurization of the vessel 33, material will accumulate in the chute 31 waiting from the valve 32 to be re-opened. So long as the material is fed at a rate less than the maximum capacity of the system, the level of the material in the chute 31 will never rise as far as the detector 44 before the valve 32 re-opens and causes the level to drop once again. However, if the feed rate exceeds the maximum capacity of the system, then the level of the material in the chute 31 will rise as far as the detector 44, and the latter will activate a control to cause feeding of the material to cease.

A further advantage of the method and apparatus according to the invention is that the hopper 30 from which material to be reclaimed is fed is not necessarily located above the level of the furnace. This enables the apparatus to be installed in a building with a relatively low roof or ceiling.

Although the invention has been described above with reference to the reclamation of foundry sand, it can also be applied to other mixtures of a base material and a combustible substance, such as greensand which is also used in foundry processes.

I claim:

1. A method of thermally reclaiming a base material from a mixture of the base material and a combustible substance, wherein the substance is incinerated in a fluidized bed, the method comprising the steps of:

mechanically comminuting the mixture;

mixing dust from the comminution step with the mixture; and feeding the mixture mixed with dust directly into a lower part of the fluidized bed.

2. The method as claimed in claim 1, wherein the mixture mixed with dust is fed into the fluidized bed from beneath the fluidized bed.

3. The method as claimed in claim 2, wherein the mixture is fed to a confined space beneath the fluidized bed by means of a mechanical conveyor.

4. The method as claimed in claim 3, wherein the mixture mixed with dust is fed to the confined space continuously.

5. The method as claimed in claim 2, wherein the mixture mixed with dust is fed to the fluidized bed by a pneumatic conveyor.

6. The method as claimed in claim 5, wherein the mixture mixed with dust is injected into the fluidized bed at substantially the same level as a fluidizing air/gas mixture.

7. The method as claimed in claim 1, wherein the mixture mixed with dust is fed to the fluidized bed in batches in a plurality of sequential feeds.

8. The method as claimed in claim 1, wherein the base material is foundry sand.

* * * * *